US007829809B2

(12) United States Patent
Bitz et al.

(10) Patent No.: US 7,829,809 B2
(45) Date of Patent: Nov. 9, 2010

(54) SWITCHING DEVICE WITH SNAP-FIT HOUSING

(75) Inventors: Matthias Bitz, St. Leon-Rot (DE); Joachim Körner, Sinsheim (DE)

(73) Assignee: ABB AG, Mannheim (DE)

( * ) Notice: Subject to any disclaimer, the term of this patent is extended or adjusted under 35 U.S.C. 154(b) by 104 days.

(21) Appl. No.: 12/217,140

(22) Filed: Jul. 2, 2008

(65) Prior Publication Data

US 2009/0014299 A1 Jan. 15, 2009

(30) Foreign Application Priority Data

Jul. 12, 2007 (DE) ..... 10 2007 032 841

(51) Int. Cl.
*H01H 9/02* (2006.01)

(52) U.S. Cl. ..... 200/303; 174/563

(58) Field of Classification Search ..... 174/559, 174/560, 561, 563

See application file for complete search history.

(56) References Cited

U.S. PATENT DOCUMENTS

| | | | | |
|---|---|---|---|---|
| 4,139,755 | A * | 2/1979 | Hastings et al. | 200/295 |
| 4,275,279 | A | 6/1981 | Wagatsuma et al. | |
| 4,485,365 | A | 11/1984 | Lerude et al. | |
| 5,362,933 | A * | 11/1994 | Kutsche et al. | 200/401 |
| 5,629,504 | A * | 5/1997 | Chang | 200/16 C |
| 6,635,833 | B2 * | 10/2003 | Vignaud | 200/47 |
| 2005/0280973 | A1 | 12/2005 | Kawata et al. | |
| 2007/0128921 | A1 | 6/2007 | Gerving | |

FOREIGN PATENT DOCUMENTS

| | | |
|---|---|---|
| DE | 37 28 907 | 3/1989 |
| DE | 689 05 497 | 10/1993 |
| DE | 196 53 300 | 6/1998 |
| DE | 103 48 088 | 1/2005 |
| DE | 10 2005 022 213 | 11/2006 |
| DE | 601 24 210 | 9/2007 |
| EP | 0 086 698 | 8/1983 |
| EP | 0 860 901 | 8/1998 |
| FR | 2 873 234 | 1/2006 |
| WO | WO 02/075889 | 9/2002 |

OTHER PUBLICATIONS

European Search Report in Application No. 08008559.0-2214 dated Nov. 28, 2008.

German Office Action in Application No. 10 2007 032 841.0 dated Jul. 2, 2008.

* cited by examiner

*Primary Examiner*—Edwin A. Leon
*Assistant Examiner*—Vanessa Girardi
(74) *Attorney, Agent, or Firm*—Buchanan Ingersoll & Rooney PC

(57) ABSTRACT

The disclosure relates to a service switching device with an insulating housing, which has a front-panel side and an opposite fastening side as well as narrow and broad sides connecting the front-panel and the fastening sides, including at least one first housing shell and at least one covering part, which are connected by a first connector, which act on the broad sides of the housing shell and the covering part and hold them together whilst forming a peripheral joining line, the insulating housing including accommodating areas for connection terminals in the region of the narrow sides. A second connector is provided in the region of a terminal accommodating area and in the region of the narrow side associated therewith, which second connector holds the housing shell and the covering part together there at the joining line.

13 Claims, 3 Drawing Sheets

SWITCHING DEVICE WITH SNAP-FIT HOUSING

RELATED APPLICATION

This application claims priority under 35 U.S.C. §119 to German Patent Application No. 10 2007 032 841.0 filed in Germany on Jul. 12, 2007, the entire content of which is hereby incorporated by reference in its entirety.

TECHNICAL FIELD

The disclosure relates to a service switching device with an insulating housing.

BACKGROUND INFORMATION

Generic service switching devices, for example line circuit breakers or residual current circuit breakers, have a front-panel side and an opposite fastening side as well as narrow and broad sides connecting the front-panel and the fastening sides, and comprise at least one first housing shell and at least one covering part, which are connected by first connecting means, which act on the broad sides of the housing shell and the covering part and hold them together whilst forming a peripheral joining line. Furthermore, the insulating housing of generic service switching devices comprises accommodating areas for connection terminals in the region of the narrow sides.

The covering part can be in a form of a second housing shell, which results in an insulating housing formed from two housing half-shells abutting one another at the peripheral joining line.

The first connecting means are conventionally riveted joints. These hold the housing shell and the covering part together at a plurality of riveting points. In this case, the rivet acts on the broad sides of the housing on both sides and passes through the housing interior. The position for the connecting rivets is therefore not freely selectable, but instead riveted joints can only be positioned where the switching device components and assemblies allow room for this in the interior of the device. The riveted joints, often 4-6 in number, for example, are therefore distributed irregularly over the broad side of the housing. In particular, it is not possible to allow first connecting means to act in a known manner in the region of the accommodating areas for the connection terminals since the terminals prevent connecting rivets from passing through there.

If the connection terminals are now in the form of screw terminals and are tightened to a greater extent than is necessary when a connecting conductor is connected, which may easily arise when using conventional working procedures in electrical installation without the use of a special torque screwdriver, it may arise that the two housing parts, namely the housing shell and the covering part, gape wide apart from one another in the region of the connection terminals, the two housings otherwise continuing to be held together firmly by the riveted joints.

This risk arises in particular when using housing parts made from thermoplastic since this material is softer and more flexible than, for example, a thermosetting plastic material. When the clamping screw is tightened to a great extent, however, the housing parts may gape apart from one another locally in the region of the connection terminals even in the case of a thermosetting plastic housing.

Even the surge in pressure forming in the case of a short-circuit switching operation in the interior of the switching device as a result of the switching arc produced at the contact point can result in the housing parts gaping apart from one another at points at which there is no riveted joint to ensure that the housing parts are held together in a stable fashion, i.e. in particular in the region of accommodating areas for the connection terminals.

The action of the housing parts gaping apart from one another is undesirable since moisture and dirt can enter the housing interior via the gap produced in the process and the functional reliability of the device can be impaired.

SUMMARY

Exemplary embodiments disclosed herein can provide a service switching device of the generic type in which the housing parts are prevented from gaping apart from one another in the region of the accommodating areas for the connection terminals.

A service switching device with an insulating housing is disclosed, which has a front-panel side and an opposite fastening side as well as narrow and broad sides connecting the front-panel and the fastening sides, comprising at least one first housing shell and at least one covering part, which are connected by first connecting means, which act on the broad is sides of the housing shell and the covering part and hold them together whilst forming a peripheral joining line, the insulating housing comprising accommodating areas for connection terminals in the region of the narrow sides, wherein a second connecting means is provided in the region of a terminal accommodating area and in the region of the narrow side associated therewith, which second connecting means holds the housing shell and the covering part together there at the joining line.

In another aspect, an insulating housing for a service switching device is disclosed. The insulating housing comprises: a front-panel side; an opposite fastening side; narrow and broad sides connecting the front-panel and the fastening sides, a region of the narrow sides having accommodating areas for connection terminals in the region of the narrow sides; and a connecting means provided in the region of a terminal accommodating area and in the region of the narrow side associated therewith. The connecting means holds a housing shell and a covering part of the service switching device together at a joining line.

BRIEF DESCRIPTION OF THE DRAWINGS

The disclosure and further advantageous configurations and improvements of the disclosure will be explained and described in more detail with reference to the drawings, in which an exemplary embodiment of the disclosure is illustrated and in which.

DETAILED DESCRIPTION

Figure 1:
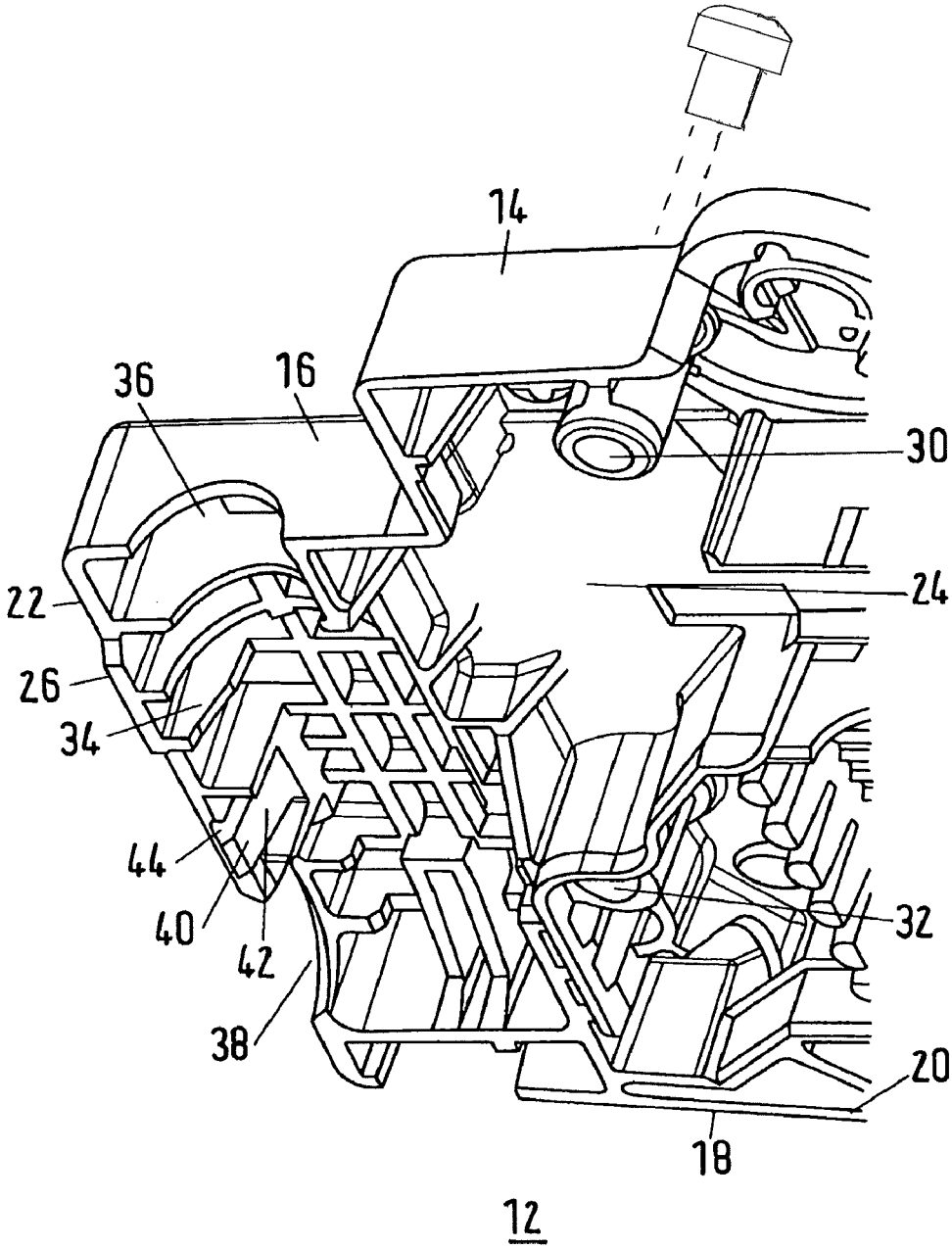
FIG. 1 shows a plan view into the interior of a first housing half-shell of a service switching device according to the disclosure in the region of a terminal accommodating area.

Therefore, according to the disclosure, a second connecting means is provided in the region of a terminal accommodating area and in the region of the narrow side associated therewith of the housing, which second connecting means holds the housing shell and the covering part together there at the joining line.

In accordance with an exemplary configuration of the disclosure, the second connecting means is a snap-action hook, which is fitted in the housing interior close to the narrow side to the housing shell or to the covering part and can be latched into a latching position with a first latching face, which is fitted to the covering part or the housing shell in a position corresponding to the snap-action hook, when the housing shell and the covering part are placed one on top of the other.

In an exemplary embodiment, the snap-action hook is a first sprung web, which protrudes at right angles with respect to the broad side in the region of the joining line and bears a latching tab with a second latching face at its free end. The sprung web with the latching tab can in this case be produced in particular in a very simple manner at the same time as when the housing shell or the covering part is injection-moulded. It can be designed to be very flat and takes up very little space, with the result that it can be fitted into the space between the connection terminal and the inner narrow side wall in the region of the joining line.

The first latching face can in this case be formed by an undercut of a connecting strip fitted to the narrow side in the region of the joining line. In this case, the strip with the undercut can also be produced together with the housing half-shell or the covering part as early as when the latter is injection-moulded.

The undercut provides a type of pocket, in which the snap-action hook latches with the second latching face when the two housing parts are joined onto one another by it resting in its latching position against the first latching face, with the result that the two housing parts are prevented from being pulled apart from one another or from gaping apart from one another by means of the latching connection.

An exemplary embodiment is disclosed in which the first latching face forms an acute angle with the connecting strip, or in which the second latching face forms an acute angle with the sprung web. As a result of the acute angle, the two latching faces are caused to claw, so to speak, one inside the other, with the result that, in the event of a force on the housing parts which acts on the outside at right angles with respect to the broad sides, in the region of the connection terminals the latching of the latching tab in the pocket with the first latching face cannot be torn apart, and thus reliably prevents the housing parts from gaping apart from one another.

In addition, in accordance with an exemplary embodiment, a locking element can be provided which acts on the snap-action hook in a sprung manner in the direction of the latching position and thus prevents unlatching when the covering part is spread apart from the housing shell in the region of the terminal accommodating area.

In accordance with an exemplary embodiment, the locking element is a second sprung web, which is fitted close to the undercut, which runs approximately parallel to the first sprung web of the latching hook and acts in a sprung manner on the latching hook in the direction of its latching position.

This ensures that the latching tab in the latching position remains in engagement with the first latching face in the pocket even if the two housing parts are pushed away from another since the sprung web pushes the web of the snap-action hook always in the direction of the latching position.

Initially, FIG. 1 will be considered. It shows a partial plan view into the interior of a first housing half-shell 12 of a service switching device, for example a line circuit breaker. The figure shows a front and a rear front-panel side 14, 16, a fastening side 18 with a stationary tab 20, by means of which, and whilst interacting with a movable tab which is opposite the fixed tab 20 and is not illustrated here, the service switching device can be fixedly clamped on a standard mounting rail, a narrow side 22 and a broad side 24 which connects the front-panel sides 14, 16 and the fastening side 18.

Figure 2:
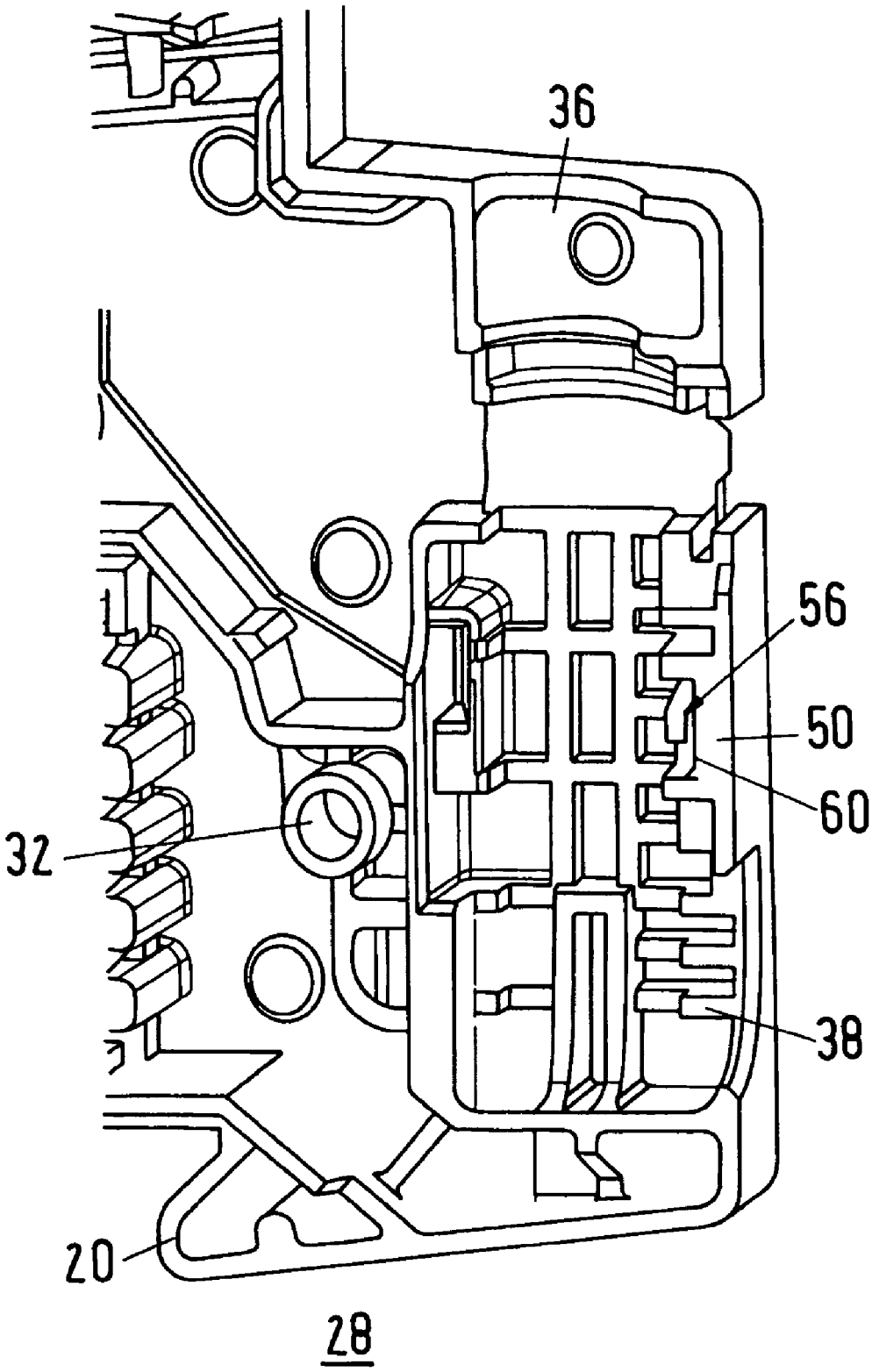
FIG. 2 shows a plan view into the interior of a second housing half-shell corresponding to the housing half-shell shown in FIG. 1.

The free edges of the front and rear front-panel sides 14, 16, the narrow side 22 and the fastening side 18 form a peripheral joining line 26, at which the first housing half-shell 12 abuts the second housing half-shell 28, which correspond to one another and together form the housing of the service device (see FIGS. 2 and 3) if the housing comprises the two housing half-shells 12, 28.

The figure shows, in the interior of the housing half-shell 12, ribs, intermediate walls and other structural elements which form subareas for accommodating and delimiting the various components and subsystems required in a service switching device, for example for the switching mechanism, the contact point, the thermal and electromagnetic releases and the arc-quenching device, all of which are not illustrated here and are also of subordinate significance in the context of the present disclosure.

A terminal accommodating area 34, which runs approximately parallel to the narrow side 22 between the rear front-panel side 16 and the fastening side 18, is provided in the region of the narrow side 22. The terminal accommodating area 34 serves the purpose of accommodating a connection terminal, by means of which a connecting conductor can be connected to the service switching device. Conventionally, screw terminals are used for this purpose, in the case of which a clamping piece can be pressed against a contact plate by means of a clamping screw and that end of the connecting conductor to be connected from which the insulation has been stripped can therefore be fixedly clamped between the clamping piece and the contact plate. For this purpose, an opening 36 for passing through a tool, for example a screwdriver, for actuating the clamping screw is provided on the rear front-panel side 16, and a further opening 38 for inserting the connecting conductor is located in the vicinity of the fastening side 18 on the narrow side 22.

The housing with the two housing half-shells can be produced from a thermoplastic using the injection-moulding process. Thermoplastic material is more cost-effective than the thermosetting plastic material which is also used, as is known, and is therefore used, for example, in devices in the lower price sector.

Cylindrical sleeves 30, 32 are fitted perpendicularly to the inner broad side 24 so as to protrude inwards and are produced in the same working step as the injection-moulding of the housing half-shell 12, with the result that they are connected to the housing half-shell in one piece. The sleeves 30, 32 serve the purpose of guiding rivets, with which the two housing halves of the service switching device are held together once all of the required inner components and assemblies have been installed. The flanging of the riveting pins takes place on the outside of the housing broad side, with the result that the rivet connectors act on the housing broad sides on the outside and push the two housing half-shells together.

In addition to the sleeves 30, 32 illustrated, further corresponding sleeves for further riveted joints are provided at a suitable point in the part of the housing half-shell 12 not illustrated here. Typically, a service switching device comprises between approximately 4 and 6 riveted joints. It is naturally also possible for riveted joints only to be fitted where space is also provided for them in the interior of the housing. This restricts the freedom in the selection of suitable points for the positioning of riveted joints for holding the two housing half-shells together.

In particular, no riveted joints can be positioned in the region of the terminal accommodating area since the connection terminals are in the way there.

A snap-action hook 40 is integrally formed on the housing shell close to the narrow side 22 in the housing interior. It is in the form of a sprung web 42, which protrudes in the region of the joining line 26 at right angles with respect to the broad side 24 and bears a latching tab 44 at its free end. The latching tab 44 bears a latching face 46, which forms an acute angle $\alpha$ with the sprung web 42, as illustrated in FIG. 3.

The sprung web 42 can be produced at the same time as the injection-moulding of the housing half-shell 12 in the same injection-moulding process and can therefore be integrally connected to the housing half-shell 12. It is designed to be very narrow, with the result that it does not take any space away for the connection terminal 48 in the terminal accommodating area 34.

Figure 3:
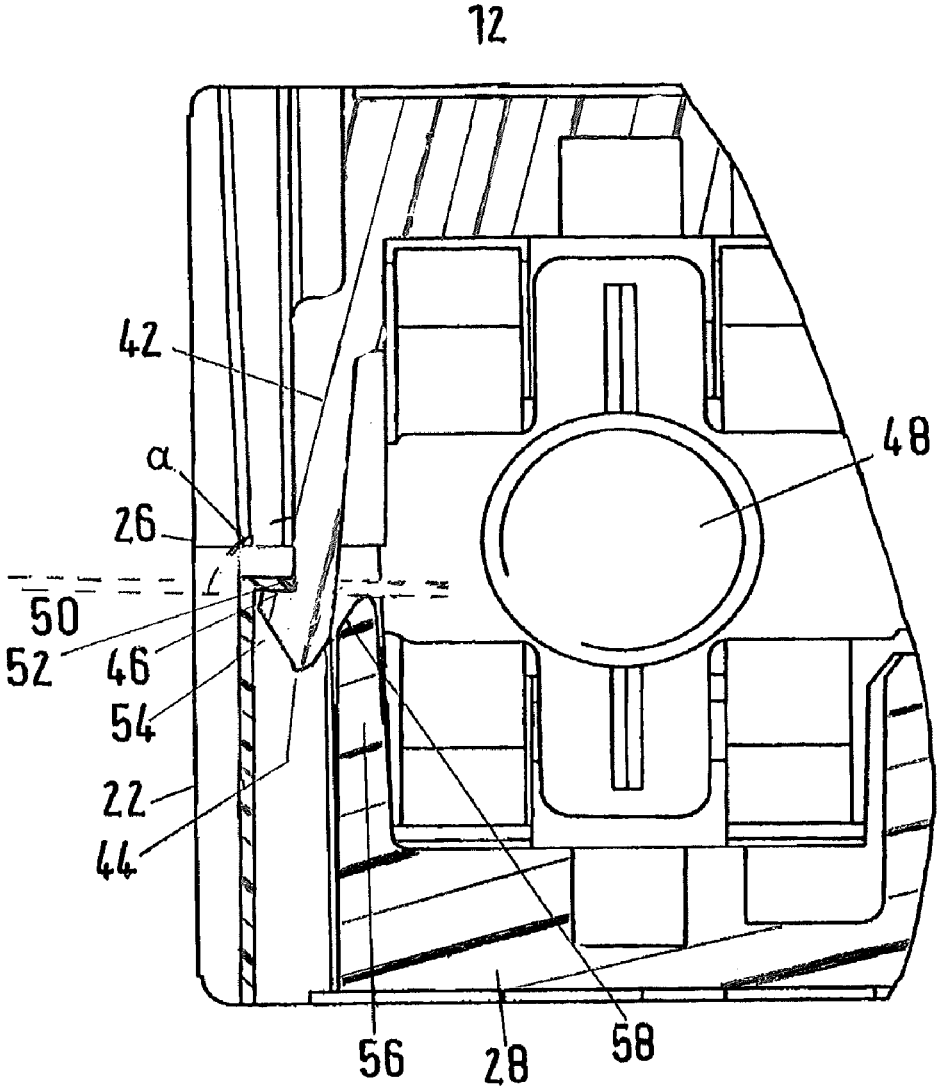
FIG. 3 shows a cross-sectional view of the front-panel side of a service switching device housing according to the disclosure in the region of the connection terminal.

FIG. 3 shows a transparent plan view of the rear front-panel side 16 of the service switching device in the region of the connection terminal 48, which is illustrated as having been inserted into the terminal accommodating area 34 in FIG. 3. A strip 50, which protrudes into the interior of the housing, with an undercut 52 is joined to the second housing half-shell 28 in the region of the joining line 26 on the narrow side 22. The strip 50 with the undercut 52 is produced at the same time as the injection-moulding of the housing half-shell 28 in the same injection-moulding process and is therefore is integrally connected to the housing half-shell 28. At the same time, the undercut 52 forms a latching face, which corresponds to the latching face 46 of the snap-action hook 40 in the latched state. The undercut likewise forms an acute angle $\alpha$ with the sprung web 42.

The latching tab 44 on the sprung web 42 of the snap-action hook 40 bears a bevel 54 facing the strip 50. If the two housing halves 12, 28 are placed one on top of the other when the housing is assembled, the sprung web is pushed away initially into the housing interior by the interaction of the bevel 54 with the strip 50 until it reaches the end position when the two housing halves lie one on top of the other, also referred to below as the latching position, the lower end of the bevel is reached and the latching tab 44 latches into the pocket formed by the undercut 52 with the latching face 46 as a result of the restoring force of the sprung web 42.

In the latching position, the two housing halves 12, 28 are therefore also held together in the region of the terminal accommodating area 34 as a result of the latching tab 44 in interaction with the undercut 52 although it is not possible for there to be a riveted joint there, as described above.

The acute angle $\alpha$ of the two latching faces 46, 52 in this case has a self-inhibiting effect in such a way, that, when the two housing halves 12, 28 are pulled apart from one another towards the outside in the perpendicular direction to the broad side 24, the two latching faces 46, 52 claw into one another, so to speak, and the latching connection is largely prevented from becoming detached.

This is particularly advantageous if a superatmospheric pressure is present in the interior of the housing, for example if arcing gases form in the case of a switching operation brought about by a short circuit at the contact point. These arcing gases can push the housing halves outwards from the inside. Without the latching as a result of the snap-action hooks, the housing halves could then possibly gape apart from one another for a short period of time close to the connection terminal, which is undesirable and is prevented by means of the local latching as a result of the snap-action hook 40 provided in accordance with the disclosure in interaction with the undercut 52.

A second sprung web 56, which points in the direction of the first housing half 12 out of the second housing half 28 perpendicular to the broad side of the housing and is oriented approximately parallel to the first sprung web 42 of the snap-action hook 40, is fitted in the second housing half 28 close to the undercut 52.

An interspace 60, which is slightly narrower than the thickness of the first sprung web 42 of the snap-action hook 40, is provided between the second sprung web 56 and the strip 50. As shown in FIG. 3, the second sprung web 56 bears, at its free end, a bevel 58, which faces the first sprung web 42. If the two housing halves 12, 28 are assembled, the latching tab 44 presses against the bevel 58 on the second sprung web 56 and bends it thereby in the direction towards the housing interior. As a result, the second sprung web 56 is to a certain extent prestressed and with its restoring spring force causes the first sprung web 42 of the snap-action hook 40 to move towards the outside in the direction of the strip 50.

As a result, to a certain extent locking of the snap-action hook 40 is achieved; the second sprung web 56 can also be regarded as a locking element for the snap-action hook 40. The advantage of this locking is as follows: as a result of the clamping screw being tightened excessively, which can arise in the everyday working life of a fitter in the case of improper handling, the two housing halves 12, 28 may gape apart from one another in the region of the connection terminal. In this case, it could happen that the latching tab 44 slides out of the pocket formed by the undercut 52 and as a result the latching is released. As a result of the resilient action of the second sprung web 56 on the first sprung web 42, however, the latching tab 44 is also guided outwards in the event of the two housing halves 12, 28 gaping apart from one another and is therefore pushed into its latching position, as a result of which the latching is maintained.

It is made more difficult for the latching tab 44 to slide out of the pocket formed by the undercut 52 even by the above-described claw-effect alone as a result of the acute angle between the latching face 46 or the undercut 52 and the sprung web 42 of the snap-action hook 40, but this is prevented effectively in interaction with the additional safety measure of the locking by means of the second sprung web 56.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the disclosure is indicated by the appended claims rather than the foregoing description and all changes that come within the meaning and range and equivalence thereof are intended to be embraced therein.

LIST OF REFERENCE SYMBOLS

12 First housing half-shell
14 Front front-panel side
16 Rear front-panel side
18 Fastening side
20 Stationary tab
22 Narrow side
24 Broad side
26 Peripheral joining line
28 Second housing half-shell
30 Cylindrical sleeve

32 Cylindrical sleeve
34 Terminal accommodating area
36 Opening
38 Opening
40 Snap-action hook
42 Sprung web
44 Latching tab
46 Latching face
48 Connection terminal
50 Strip
52 Undercut
54 Bevel
56 Second sprung web
54 Bevel
60 Interspace

What is claimed is:

1. Service switching device comprising:

an insulating housing, including, at least one housing shell including a front-panel side and an opposite fastening side as well as narrow and broad sides connecting the front-panel and the fastening sides;

at least one covering part, wherein the at least one housing shell and the at least one covering part are connected by first connecting means, which act on the broad sides of the at least one housing shell and the at least one covering part and hold them together whilst forming a peripheral joining line;

accommodating areas for connection terminals adjacent the narrow sides; and a second connecting means provided adjacent a terminal accommodating area and in the region of the narrow side associated therewith, which second connecting means holds the at least one housing shell and the at least one covering part together at the peripheral joining line wherein the second connecting means is a snap-action hook, which is fitted in a housing interior close to the narrow side of the at least one housing shell or the at least one covering part and can be latched into a latching position with a first latching face, which is fitted to the at least one covering part or the at least one housing shell in a position corresponding to the snap-action hook, when the at least one housing shell and the at least one covering part are placed one on top of the other, the snap-action hook being a first sprung web, which protrudes at right angles with respect to the broad side of the at least one housing shell or the at least one covering part and in the region of the joining line and bears a latching tab with a second latching face at its free end, the second latching face forming an acute angle with the sprung web; and a locking element being provided which acts on the snap-action hook in a sprung manner in the direction of the latching position for preventing unlatching when the at least one covering part is spread apart from the at least one housing, shell in the region of the terminal accommodating area.

2. Service switching device according to claim 1, the first latching face being formed by an undercut of a connecting strip fitted to the narrow side of the at least one housing shell or the at least one covering part in the region of the joining line.

3. Service switching device according to claim 2, the first latching face forming an acute angle with the connecting strip.

4. Service switching device according to claim 1, the at least one covering part being in the form of a second housing shell.

5. Service switching device according to claim 4, the first connecting means being riveted joints or screw connections.

6. Service switching device according to claim 1, the first connecting means being riveted joints or screw connections.

7. Service switching device according to claim 6, the joining plane covered by the peripheral joining line runs parallel to the broad sides of the at least one housing shell and the at least one covering part.

8. Service switching device according to claim 1, the joining plane covered by the peripheral joining line runs parallel to the broad sides.

9. Service switching device according to claim 8, with a housing made from thermoplastic.

10. Service switching device according to claim 1, with a housing made from thermoplastic.

11. Service switching device, comprising:

an insulating housing, including, at least one housing shell including a front-panel side and an opposite fastening side as well as narrow and broad sides connecting the front-panel and the fastening sides;

at least one covering part, wherein the at least one housing shell and the at least one covering part are connected by first connecting means, which act on the broad sides of the at least one housing shell and the at least one covering part and hold them together whilst forming a peripheral joining line;

accommodating areas for connection terminals adjacent the narrow sides;

a second connecting means provided adjacent a terminal accommodating area and in the region of the narrow side associated therewith, which second connecting means holds the at least one housing shell and the at least one covering part together at the peripheral joining line wherein the second connecting means is a snap-action hook, which is fitted in a housing interior close to the narrow side of the at least one housing shell or the at least one covering part and can be latched into a latching position with a first latching face, which is fitted to the at least one covering part or the at least one housing shell in a position corresponding to the snap-action hook, when the at least one housing shell and the at least one covering part are placed one on top of the other; and a locking element being provided which acts on the snap-action hook in a sprung manner in the direction of the latching position for preventing unlatching when the at least one covering part is spread apart from the at least one housing shell in the region of the terminal accommodating area.

12. Service switching device according to claim 11, the locking element being a second sprung web, which is fitted close to the undercut, which runs approximately parallel to the first sprung web of the latching hook and acts in a sprung manner on the latching hook in the direction of its latching position.

13. Service switching device according to claim 12, the at least one covering part being in the form of a second housing shell.

* * * * *